US007673355B2

(12) United States Patent
Fischer

(10) Patent No.: US 7,673,355 B2
(45) Date of Patent: Mar. 9, 2010

(54) RAPID MULTI-ACTION RESCUE SLED

(76) Inventor: Matthew D. Fischer, 2202 Gillis St., Alton, IL (US) 62002

( * ) Notice: Subject to any disclaimer, the term of this patent is extended or adjusted under 35 U.S.C. 154(b) by 0 days.

(21) Appl. No.: 12/174,748

(22) Filed: Jul. 17, 2008

(65) Prior Publication Data

US 2010/0011507 A1 Jan. 21, 2010

(51) Int. Cl.
*A47B 1/00* (2006.01)

(52) U.S. Cl. ..... 5/625; 5/628; 280/15

(58) Field of Classification Search ..... 280/14.27, 280/15, 18, 19, 24, 28, 28.16
See application file for complete search history.

(56) References Cited

U.S. PATENT DOCUMENTS 5,306,026 A * 4/1994 Jesse ..... 280/18
7,036,167 B2 * 5/2006 Tomcany et al. ..... 5/628

* cited by examiner

*Primary Examiner*—Peter M Cuomo
*Assistant Examiner*—Nicholas Polito
(74) *Attorney, Agent, or Firm*—Don W. Weber

(57) ABSTRACT

A flat, sturdy rescue board is shaped like a sled. The long edges of the board platform have wings for attaching handles or arm hooks to the platform. A rotatable handle is attached to each wing. Each handle can rotate ninety degrees only. The handles are normally parallel to the top of the board surface but may be rotated ninety degrees so that they are perpendicular to the board. When a victim is loaded onto the board the handles may be used to extricate the board and victim from the dangerous situation. Semi-circular arm hooks may also be attached to each wing. When a victim is loaded onto the board, his arms are positioned above the hooks. When the board is pulled to safety the victim remains secured to the board by the arm hooks. The board also has lower rails attached to the bottom of the board for sliding the board along ice or on long the ground.

2 Claims, 5 Drawing Sheets

RAPID MULTI-ACTION RESCUE SLED

BACKGROUND OF THE INVENTION

This invention relates to the field of emergency rescue. More particularly, a rescue board for extricating victims from mass casualty or ice rescue incidents is presented.

In the field of emergency rescue, it is often necessary to extricate victims from dangerous surroundings, buildings on fire, the water or near or underneath broken ice in lakes, ponds or rivers. The most commonly used device is a rescue board, which is usually a flat, sturdy board designed to carry a victim to an ambulance or other safe area.

Most flat rescue boards are designed to load the victim onto the board once the victim has been accessed. In some instances, such as when the victim is in a crashed car or in icy water, the board can also be used to extricate the victim from the emergency situation in the first instance. In the particular emergency where the victim has fallen through ice on a lake, pond, river or other body of water, it would be highly desirable to have a rescue board that is not only capable of transporting the victim once loaded onto the board but that may also be used to extricate the victim from the emergency environment initially. It is a main object of this invention to provide a rescue board that may be used to extricate a victim from a dangerous environment and to then transport the victim to safety.

A good example of one type of rescue board is found in the 1988 patent issued to Rudy, U.S. Pat. No. 4,736,474. Rudy disclosed a rescue transportation device in the form of a solid board 12 having hand lift openings 13. The hand lift openings in Rudy are round and are located near the left and right front and rear of the board. Rudy utilizes a number of straps 22, 24, 26, and 28 to secure the victim to the board. Once strapped to the board, the victim can be carried to the ambulance or other safe location. The Rudy rescue board would be very useful in locations where the victim is open to the rescuers but would be more difficult to use where the victim is not open to the rescuers, such as under or inside a crashed vehicle or floating near the surface of an otherwise ice-covered body of water. It is an object of this invention to create a rescue board where the rescuers are able to load the victim onto the board and secure the victim to the board even when the victim is in an area where he is not easily accessible.

Other innovative attempts have been made to create useful rescue devices for loading and carrying a victim to safety during a rescue. Kidd disclosed a casualty transfer system for ship-to-shore transfer of victims and for mountain rescues in his 1980 U.S. Pat. No. 4,183,110. The Kidd device comprises a reinforced plastic shell that is buoyant and protects the victim by surrounding him with the protective shell. Recognizing the difficulty with mountain rescues or rescues that require transporting the victim over longer distances, Kidd disclosed that steel skids or runners could be used over rough ground or on snow or ice. Kidd's device would be good for transporting the victim once the victim is loaded onto the rescue device, but would be cumbersome if the extrication of the victim had to be made under icy water or other difficult conditions. It is another object of this invention to provide a rescue board that may be slipped under a victim who is not easily accessible that also has runners for use on snow or ice.

A rescue board must meet certain basic criteria to be useful in rescues. First, it must be lightweight enough to be easily carried by rescuers but should be sturdy enough to carry victims whether they be small children or fully grown adults. Secondly, a rescue board must have a way to secure the victim to the board to some degree and handgrips for the rescuer to use when he carries the victim to safety. It would also be desirable if the rescue board had rails or skids for dragging the loaded victim to safety over ice or other terrain. Finally, it would be highly desirable if the rescue board could also be slipped under the victim in the emergency environment so that the victim could be extricated while secured in some fashion to the board. It is an object of this invention to provide such a rescue board.

Other and further objects of this invention will become obvious upon reading the below described disclosure of the invention.

BRIEF DESCRIPTION OF THE INVENTION

The rapid multi-action rescue sled is a flat, sturdy platform for extricating victims of accidents such as occurs when a victim falls through ice on a lake or river. The platform is about 42 inches long and about 22 inches wide and is shaped like a sled, the front end curved outwardly and the rear end curved inwardly and has two bottom rails. Hand gripping slots are located around the perimeter of the sled. The sled platform has a wing on both long edges. Each wing supports a removable handle that normally is parallel to the surface of the sled platform but may be rotated ninety degrees vertically in certain rescue situations. The wings can also support detachable semi-circular arm hooks used to secure a victim to the platform during rescues.

DETAILED DESCRIPTION OF THE INVENTION

Figure 1:
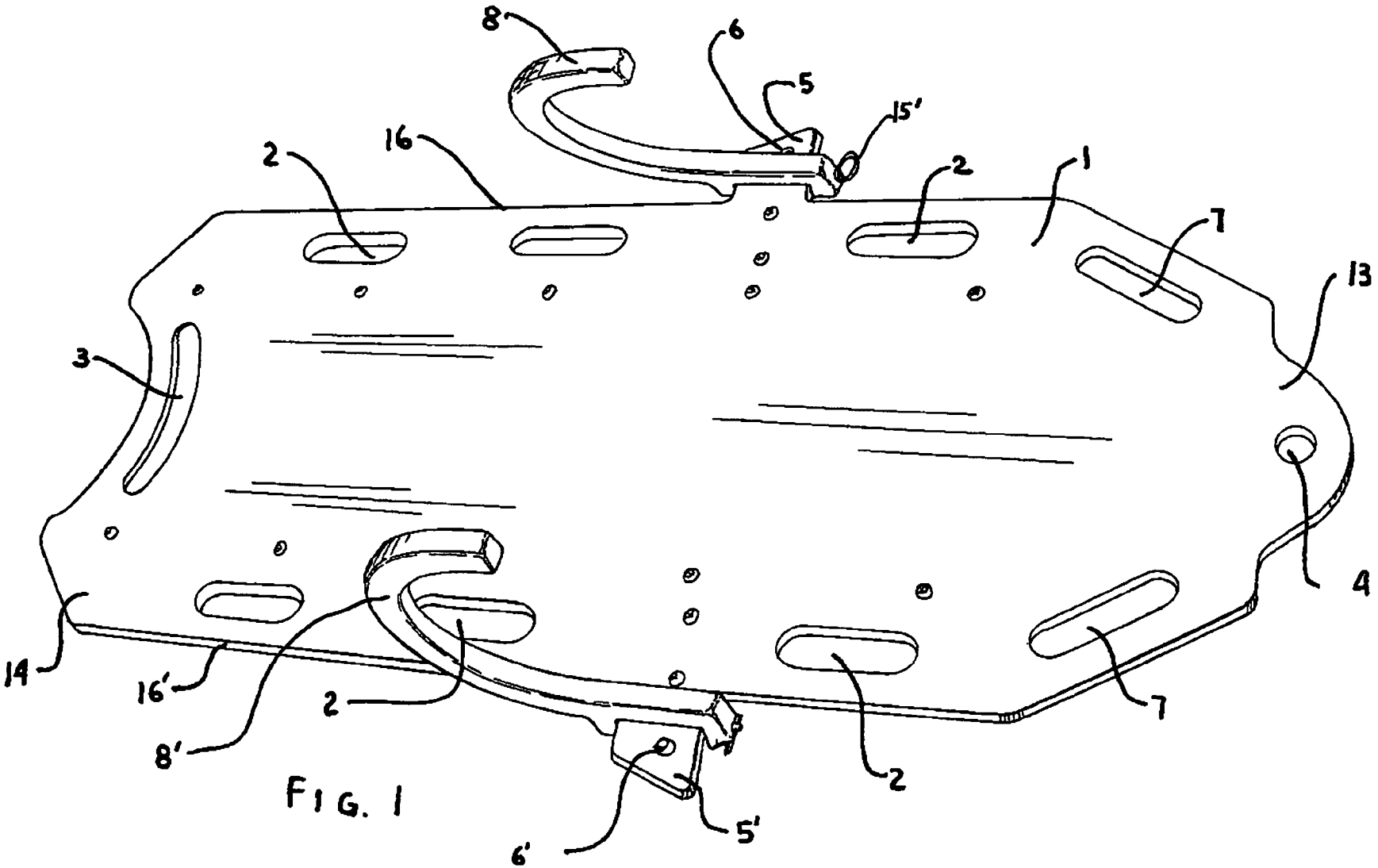
FIG. 1 is a top perspective view of the device.

A rescue board has as its main component a flat, sturdy platform 1 which has an irregular shape as shown. The board is approximately three-fourths (¾) of an inch thick, twenty-one and a half inches (21½) wide and forty-two (42) inches long. The board is preferably made of commercial grade plastic that is both sturdy and lightweight. The platform 1 is rigid and capable of supporting a full grown human being in rescue situations. The platform 1 is shaped like a sled, with a front end section 13 curved outwardly and a rear end section 14 curved inwardly as shown in the drawing figures.

Figure 2:
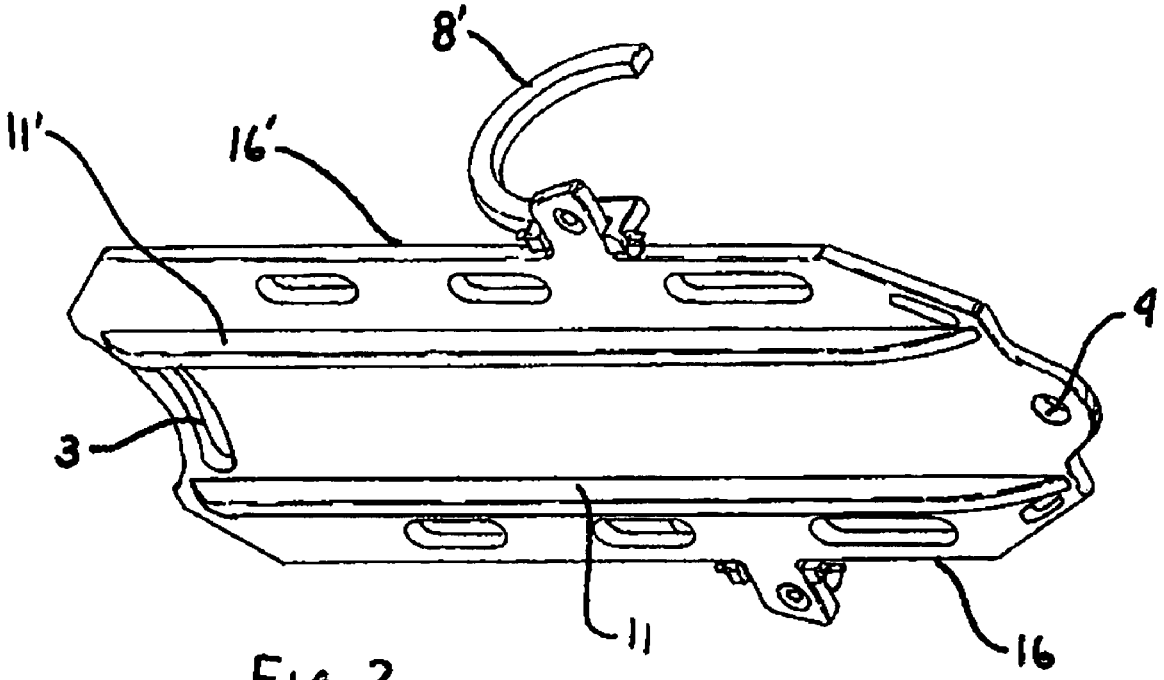
FIG. 2 is a bottom perspective view of the device.

As shown in FIGS. 1 and 2, the board platform has left 16 and right 16' long sides parallel to each other. A long axis is parallel to the long sides and runs from the front end 13 to the rear end 14.

The platform 1 has a plurality of hand gripping slots 2 located along the perimeter of the platform board. The left 16 and right 16' long edges of the board have a number of hand gripping slots. A rear gripping slot 3 is located near the rear end 14 of the platform. A front rope attachment hole 4 is located in the front outwardly curved section 13. Front gripping slots 7 are located obliquely in the front outwardly curved section 13 perimeter.

Figure 6:
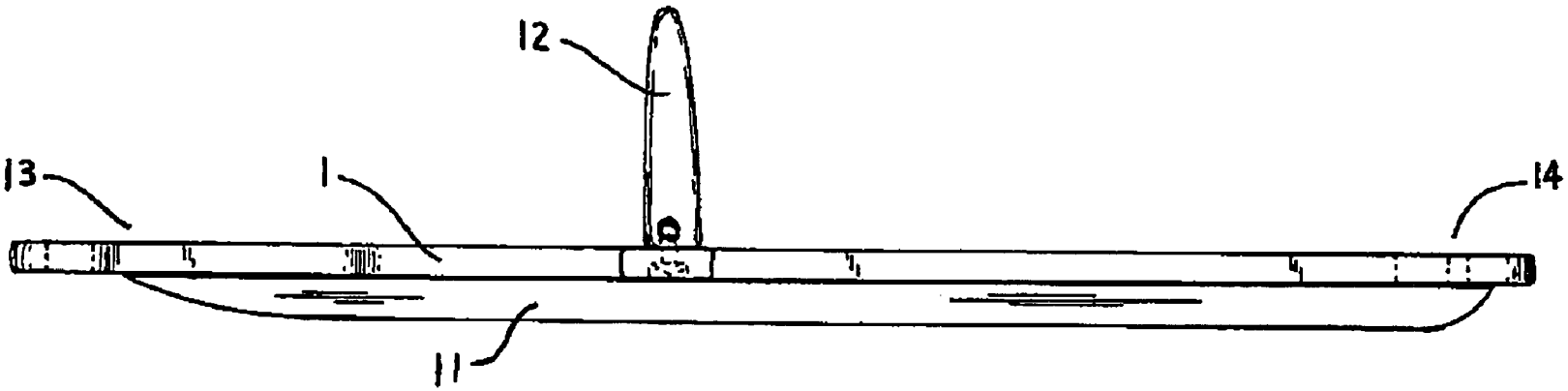
FIG. 6 is a side view of the board showing the rotatable handles attached in the upright position.
Figure 8:
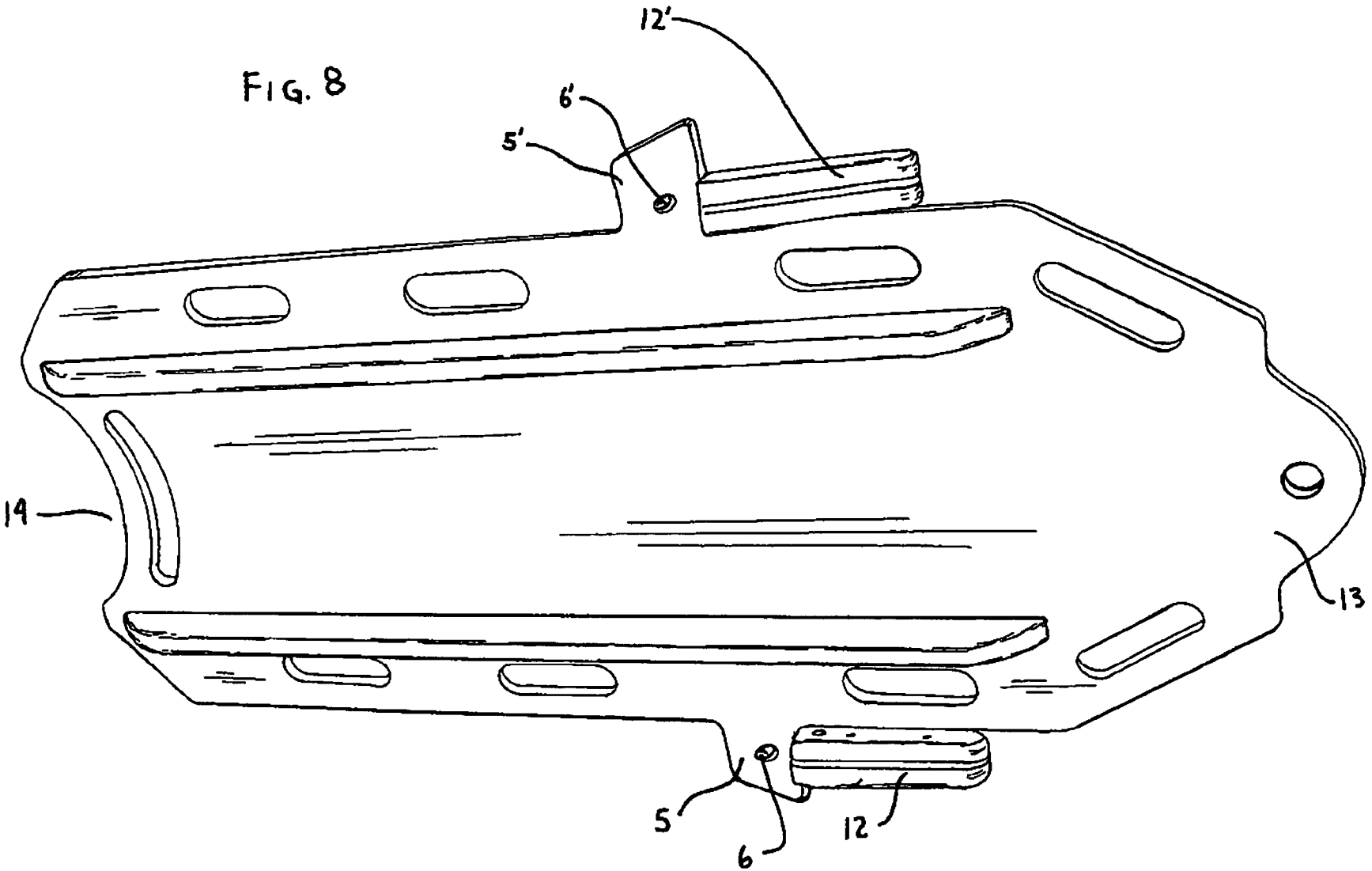
FIG. 8 is a lower perspective view of the board with the handles shown in the parallel position.

The sled like platform 1 also has left 5 and right 5' handle wings located approximately one-third (⅓) of the distance from the front of the platform. These handle wings 5 and 5' are attached to the long sides of the platform and are integral with the body of the platform. The wings are on the same upper and lower plane as the platform, as best shown in FIGS. 6 and 8.

Each left and right wing has a vertical threaded hole 6 and 6', respectively. As shown on FIGS. 1 and 8, these vertical threaded holes are adapted to receive removable and pivotable handles 12 and 12' as will be explained.

Figure 4:
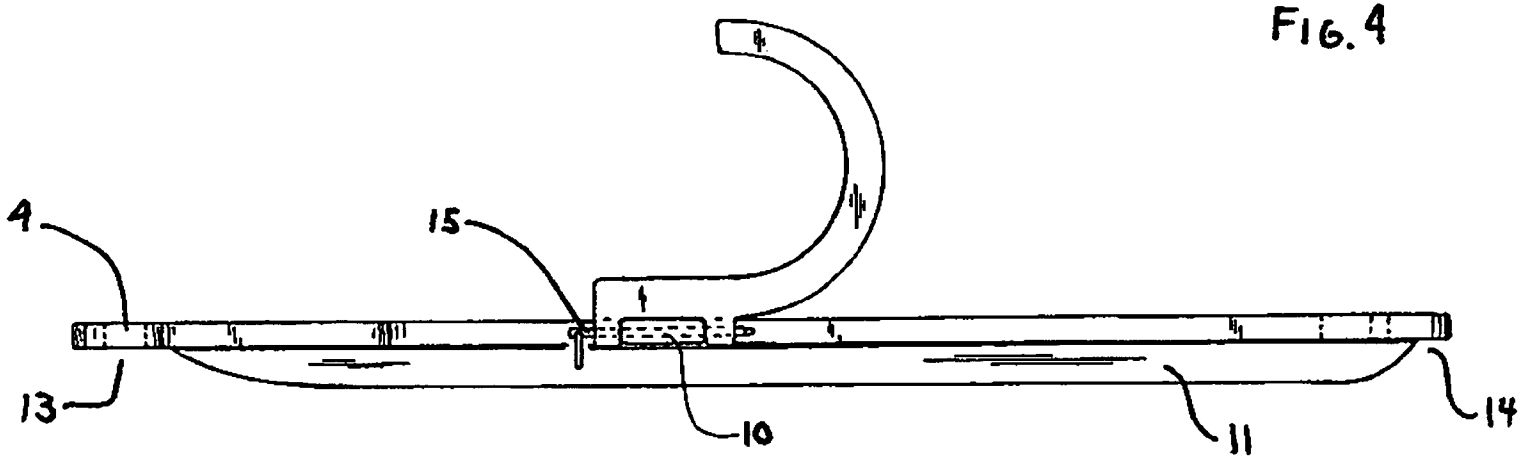
FIG. 4 is a side view of the device with the arm hook attached, the front of the board located to the left of the drawing figure.
Figure 5:
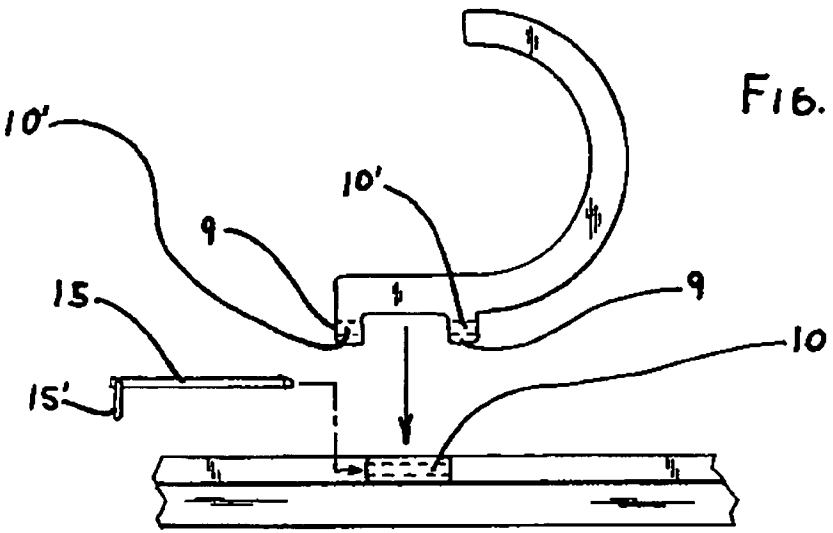
FIG. 5 is a side exploded view of the device with the arm hook detached from the board.

As best shown in FIGS. 4 and 5, each wing 5 and 5' also has a horizontal wing arm hook bore 10 located near the handle threaded holes 6 and 6'. The arm hook bore 10 is adapted to receive the removable fastening pin 15 for attaching the arm hooks in certain situations. As shown in FIG. 5, the fastening pin 15 is a long rod having a circular gripping end 15' attached to facilitate removal of the pin.

A unique feature of this device is the detachable, semi-circular left 8 and right 8' arm hooks. The arm hooks are best shown in FIGS. 1, 4 and 5. The arm hooks are essentially semi-circular and have lower arm hook flanges 9. A central arm hook bore 10' is located in each lower flange 9. As best shown in FIG. 4, to attach the arm hook, the arm hook bore 10' is aligned with the handle wing bore 10 and the fastening pin 15 is placed through the arm hook 10' and wing bore 10. The arm hooks are thus attached to the wings by the placement of the pin 15 as shown in FIGS. 1 through 4.

The arm hook bores 10 and 10' in the wings are located near the vertical handles and are used in certain rescue operations to help extricate a victim. Normally in rescue operations one person is needed to pull the rescue board and another rescuer is needed to hold the victim on the board. The arm hooks allow for a one man rescue operation by securing the victim to the board in a simple manner.

The arm hooks 8 and 8' are used to secure a victim to the board in hazardous situations by sliding the rescue board under the victim and then positioning the victim's arms above the hooks (above the hooks but below the front end of the sled). When the sled is then pulled to safety with the victim on the board, the placement of the victim's arms above the hooks keeps the victim on the rescue board.

Figure 3:
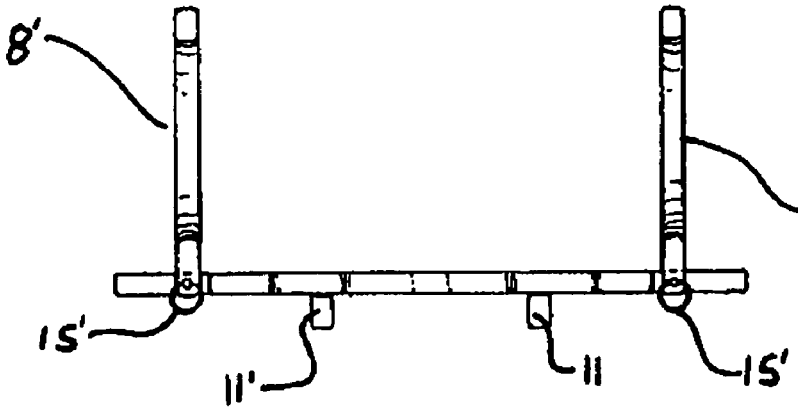
FIG. 3 is a front view of the device.

As best shown on FIGS. 2, 3 and 4 a plurality of bottom rails is attached to the bottom of the platform 1. The bottom rails 11 and 11' are secured parallel to the long axis of the platform. The long axis of the platform is the axis in the center of the platform and parallel to the long sides thereof, running from the front end 13 to the rear end 14 of the platform. In the preferred embodiment, left 11 and right 11' rails are attached. The rails may be attached by any practical method, such as by a plurality of screws.

Figure 7:
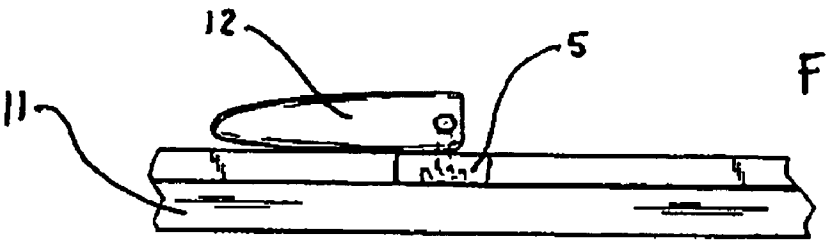
FIG. 7 is a detailed view of the rotatable handle shown in the parallel position.

Another unique feature of the present rescue board is the removable, detachable and pivotable upright handle. As shown on FIGS. 6,7 and 8, left 12 and right 12' pivotable handles may be secured to the left 5 and right 5' platform wings using the threaded holes 6 and 6' respectively. The upright handles are designed such that they may either be folded normally horizontally, parallel to the long axis of the board towards the front section 13 of the platform 1, as shown in FIG. 6, or rotated to the vertical, upright perpendicular position of the horizontal platform 1. The handles will not fold towards the rear 14 of the platform 1 but are configured to pivot only ninety (90) degrees between the horizontal position shown in FIG. 8 and the vertical position shown in FIG. 6. The wings 5 and 5' are integral with the rescue board 1 as shown in FIGS. 6 and 8.

The pivotable handles 12 and 12' are normally attached to the wings 5 and 5' and are used for extricating a victim when the handles are rotated to the vertical, upright position shown in FIG. 6. The rescuer has the option of sliding the platform underneath the victim with the handles folded parallel to the board as in FIG. 8 and then rotating the handles ninety degrees as in FIG. 6 to pull the sled and victim to safety. Since the pivotable handles will only rotate ninety degrees to the vertical, they may be used horizontally to position the victim on the sled and then vertically to pull the rescue sled and victim out of the dangerous situation.

Although the handles 12 and 12' may be removable, they are normally attached by the threaded holes in the preferred embodiment. The method to accomplish the 90 degree rotation is commonly known in the art. It may consist of a one-way ratchet mechanism or may be a compressed washer and stop mechanism.

The rescue board may be used in a variety of rescue operations. The attached rotatable handles are a new innovation and are best utilized in rescues involving a victim in icy water. The rotatable handles, used in conjunction with the semi-circular arm hooks enable a rescuer to slide the board under the victim, secure him to the board with the hooks and extricate the victim and board using the upright handles. The bottom rails facilitate pulling the victim and board to safety whether it is on ice or rugged terrain.

The invention claimed is:

1. A rescue sled for extricating victims from dangerous situations, comprising:

(a) an essentially flat, sturdy platform having left and right essentially parallel long sides, a long axis parallel to said sides and a front and a rear end and having gripping slots located along the perimeter of said platform;

(b) left and right protruding wings integral with said platform located on the perimeter of the left and right long sides, respectively, wherein said protruding wings are attached to and on the same upper and lower plane as the platform;

(c) left and right detachable pivotable handles secured to the left and right protruding wings, respectively, wherein said handles are normally folded horizontally towards the front of the platform when placing the flat platform under a victim and wherein said handles may be pivoted only ninety degrees from the front horizontal position to the perpendicular vertical position to enable a rescuer to pull the rescue sled to extricate a victim;

(d) left and right semi-circular arm hooks detachably secured to the left and right protruding wings, respectively wherein a victim may be secured to said platform by sliding the flat rescue board under the victim and then attaching the victim's arm under the arm hooks;

(e) a plurality of lower rails attached to the bottom of said platform parallel to the long axis of said rescue board.

2. A rescue sled for extricating victims from dangerous situations as in claim 1, wherein said wings have a wing bore and said semi-circular hooks have a hook bore, further comprising a fastening pin for detachably securing said arm hooks to said wings.

* * * * *